United States Patent [19]

Kolibas

[11] 4,414,248

[45] Nov. 8, 1983

[54] METHOD FOR THE STRIPING OF THE INSIDE SEAM OF A CAN BODY MOVING AT A HIGH SPEED

[75] Inventor: James A. Kolibas, Cleveland, Ohio

[73] Assignee: Nordson Corporation, Amherst, Ohio

[21] Appl. No.: 386,003

[22] Filed: Jun. 7, 1982

Related U.S. Application Data

[62] Division of Ser. No. 245,939, Mar. 20, 1981, Pat. No. 4,353,326.

[51] Int. Cl.[3] ..... B05B 12/04; B05B 12/02; B05D 7/22; B05D 1/02

[52] U.S. Cl. ..... 427/236; 427/424

[58] Field of Search ..... 427/236, 424

[56] References Cited

U.S. PATENT DOCUMENTS 3,921,570 11/1975 Hogstrom et al. .

3,995,075 11/1976 Cernauskas et al. ..... 118/317 X

*Primary Examiner*—James R. Hoffman

*Attorney, Agent, or Firm*—Wood, Herron & Evans

[57] ABSTRACT

A method and apparatus for applying a coating material to the inside seams of a series of can bodies which are moving along on can forming apparatus at high speeds. The apparatus comprises two spray guns mounted in tandem at the end of the can forming apparatus which are fired alternately so that each gun coats every other can body. The coating apparatus is designed so that coating material is only sprayed when a can body is above a spray nozzle so that errant coating material does not foul up the forming apparatus. The apparatus also provides for an adjustable nozzle on each gun so that each gun can be independently adjusted.

3 Claims, 6 Drawing Figures

METHOD FOR THE STRIPING OF THE INSIDE SEAM OF A CAN BODY MOVING AT A HIGH SPEED

This is a continuation, division, of application Ser. No. 245,939, filed Mar. 20, 1981, now Pat. No. 4,353,326.

BACKGROUND OF THE INVENTION

This invention relates to the application of protective coatings to the interior of cans and more particularly, to the application of protective coatings to the interior soldered, welded or adhered overlapped seam or the butt welded seam of a three piece metal can.

Metal cans are made by either one of two processes. One process, the two piece can process, involves drawing a cup from a sheet of metal and subjecting this cup to an ironing press where it is forced through a mandrel forming the cup into a can configuration. The other process, the three piece process involves forming a cylindrical can body from a sheet of metal and then attaching two lids or ends to the opposite ends of the body. The invention of this application is concerned only with the application of protective coatings to three piece cans.

In the manufacture of three piece cans, the cylindrical bodies of the cans are formed by wrapping a sheet of metal around a so-called stubhorn. The ends of the sheet are either butted or overlapped and secured together by either a welded seam, a soldered seam, or a cemented seam as they move longitudinally down the stubhorn. These formed cans travel at an extremely rapid speed down the stubhorn with only a small space between consecutive can bodies.

It is generally the practice in the can industry to apply coating material such as vinyl lacquers onto the inside of the cans to prevent the metallic can bodies from contaminating the contents of the can and to prevent leakage.

Frequently, the entire inside surface of the can is coated. In the alternative, or in addition to this first coating, a different coating can be applied which is limited to the can seam. The present invention is primarily concerned with the application of coating material to the inside seams of three piece cans.

This coating is applied as a spaced line of cans move off or along the stubhorn and past a spray apparatus to the end of the stubhorn.

It is preferable for the gun to fire intermittently so that the coating matetrial is sprayed only when a can body is above the nozzle and not at the space between consecutive cans. This prevents excess coating material from fouling up the machinery and also prevents waste.

Prior art guns are typically pneumatically or electrically operated spray guns. The present application is further limited to pneumatically operated spray guns. These prior art pneumatic spray guns are capable of operating with can forming machines producing up to about 400 cans per minute. As an example, at 400 cans per minute, the spray gun must be on for about 140 milliseconds and off for 10 milliseconds and then on again. This 10 milliseconds time for turning off and then on again is the limit of prior art guns. However, can forming machines can operate at much higher speeds. These guns cannot turn off and back on in much less than about 10 milliseconds. Electrically operated guns can function at these speeds, but are undesirable because of heat build up as well as sparking which could ignite the coating material.

Therefore, it is an object of the present invention to coat cans at a rate in excess of 400 cans per minute. Furthermore, it is an object of the present invention to do this using state of the art pneumatic spray guns.

These and other objectives are accomplished by combining two or more spray guns lined up in tandem. The guns are fired alternately so that a single gun does not spray two consecutive cans. The preferred embodiment comprises two guns in tandem which are fired alternately. Thus, a gun turns off as a can is coated and passes by and turns on only after the next can has passed over the gun and the edge of the third can passes over the spray gun. For example, when seven inch can bodies are being coated and are spaced ½ inch apart, the on/off time is increased for each gun by 1400%. Thus, by doubling the number of guns, the capacity of the coating apparatus increases 1400%.

Attaching two spray guns to the end of the stubhorn does present the problem of adjusting the nozzle of each gun. It is important particularly with airless spray coating to properly position the spray nozzle with respect to the passing can bodies. Therefore, the present invention also includes means to adjust the position of the nozzle of one gun independently of the second gun.

These and other advantages of this invention will be more readily apparent from the detailed description of the invention.

DETAILED DESCRIPTION OF THE INVENTION

Figure 1:
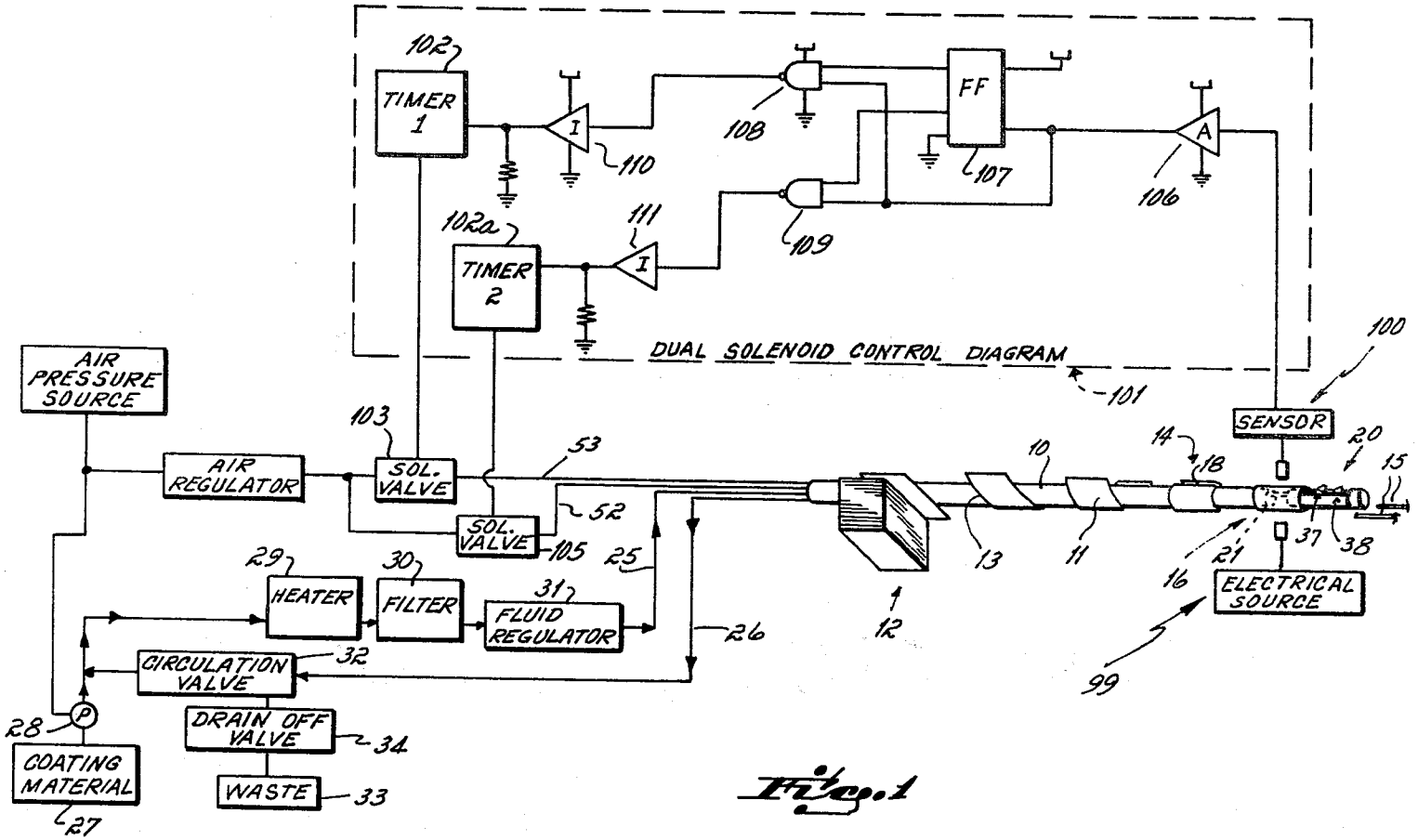
FIG. 1 is a diagrammatic illustration of a can body production line for practicing the novel inside striping method of the present invention and including the novel apparatus of this invention.

Referring first to FIG. 1, there is illustrated diagrammatically a standard can production line used in the production of cylindrical can bodies. This line includes a stubhorn 10 which acts as a mandrel around which can bodies 11 are formed as they pass downstream over the stubhorn. The can bodies 11 are moved longitudinally over the stubhorn from a magazine 12 by lugs of a chain conveyor (not shown) which engage the read edge 13 of the bodies and push the bodies along the stubhorn. As the bodies pass off the stubhorn, after having been formed into a cylindrical configuration they move into a network of rails through which the bodies pass during continued formation of the can.

In the final stages of movement of the can bodies over the stubhorn 10, the ends of the sheet metal from which the body is made are overlapped or joined. If the bodies are to be seamed by adhesive or by a solder, the solder or adhesive is placed in the overlapped seam at a seaming station indicated by the numeral 14. As the bodies pass off of the stubhorn 10 and into the rails 15, they are crimped and pass through an inside striping station indicated by the numeral 16. At this station, a stripe of protective material is sprayed over the overlapped seam 18 of the can.

In order to apply the stripe of protective material over the seam of the can, a spray apparatus 20 is secured to the end of the stubhorn. This apparatus is so positioned that the can bodies pass over it before passing into the rails 15. The spray apparatus is secured to the stubhorn by a rod 22 which extends from the end 21 of the stubhorn into a corresponding aperture 23 in the spray apparatus 20. The spray apparatus 20 is secured to the rod by bolts 24 (see FIG. 3).

In one preferred embodiment (FIGS. 1 and 5), the spray apparatus 20 is of the so-called circulating flow type, that is, there is a continuous flow of fluid or coating material to the gun through a fluid inlet line 25. There is also a continuous flow of fluid or lacquer from the apparatus via return line 26. As a result of this continuous flow, the temperature of the fluid or lacquer may be maintained constant in the spray apparatus even when the apparatus is not in use and the fluid would otherwise be stationary. Since some lacquers or can protective materials are applied at a temperature substantially above room temperature, it is important that these lacquers not be permitted to stand and become hardened in the gun. The circulating flow of fluid through the spray apparatus 20 precludes this hardening or setting of the lacquer. In the case of other lacquers which are applied at ambient or room temperature, temperature control is not important and a conventional non-circulating or one fluid line spray apparatus may be used.

As shown diagrammatically in FIG. 1, the fluid inlet line 25 originates at a source 27 of coating material and is caused by a pump 28 to pass through a heater 29, a filter 30, and a regulator 31 to the spray apparatus. The return fluid is directed from return line 26 to a circulation valve 32 which either directs the fluid back to line 25 or to a waste receptacle 33 by way of a drain off valve 34.

Figures 2, 3, 4, 5:
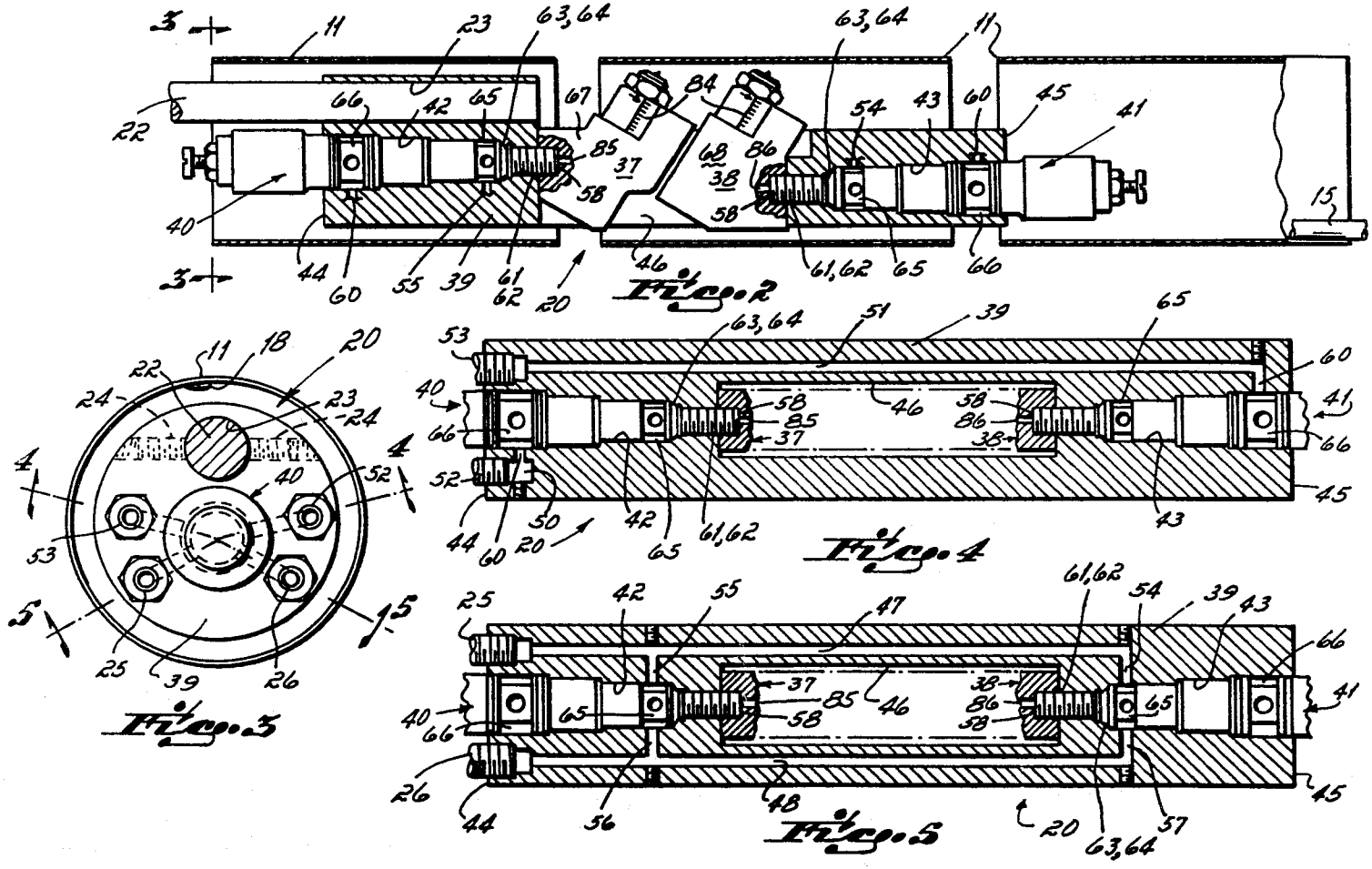
FIG. 2 is a cross-sectional view of the inside striping mechanism of the present invention.
FIG. 3 is an end elevational view of the coating apparatus of the present invention taken on line 3—3 of FIG. 2.
FIG. 4 is a cross-sectional view partially broken away taken on line 4—4 of FIG. 3.
FIG. 5 is a cross-sectional view partially broken away taken on line 5—5 of FIG. 3.
Figure 6:
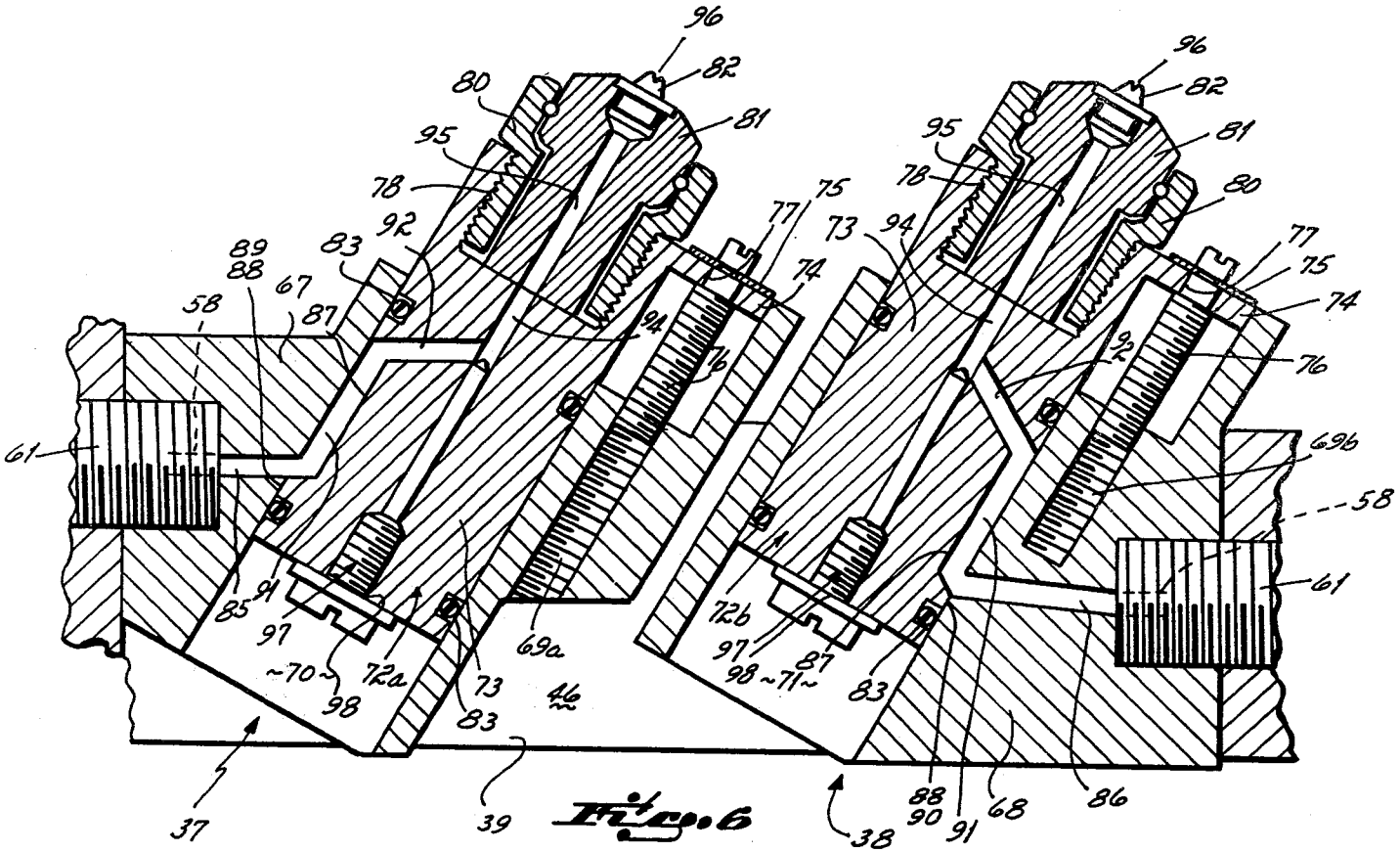
FIG. 6 is a cross-sectional view of the nozzle assembly of the present invention.

As shown in FIG. 2, the preferred apparatus 20 comprises two spray guns 37, 38 mounted within a single gun mounting block 39. The mounting block is preferably cylindrical and is adapted to receive the spray guns 37 and 38 mounted in tandem or with one gun mounted behind the other relative to can bodies 11 moving past the guns. Liquid spray material is supplied to the spray guns 37, 38 through the gun mounting block 39 via gun or flow control modules 40, 41. These modules are conventional pneumatically operated fluid flow control valves commonly employed in the spraying arts and well known to persons skilled in these arts. One such flow control module suitable for use in this application is described in detail in U.S. Pat. No. 3,840,158, issued Oct. 8, 1974, and assigned to the assignee of this application which is hereby incorporating into this application by reference.

These gun modules 40, 41 are mounted within module mounting bores or apertures 42, 43 or the gun mounting block 39. The modules 40, 41 function as flow control valves for supplying liquid to the guns 37, 38, respectively. These bores 42, 43 extend from opposite ends 44 and 45 of the gun body block and intersect a transverse slot or cavity 46 of the block. The spray guns 37, 38 are mounted within this transverse slot 46.

As may be seen in FIG. 5, the gun body block 39 includes a liquid spray material inlet flow passage 47 communicating at one end with fluid inlet line 25 and a liquid outlet fluid passage 48 communicating at one end with return line 26. In addition, the gun body includes air flow passages 50, 51 which communicate with air pressure lines 52 and 53, respectively.

The fluid inlet passage 47 extends parallel to the horizontal axis of the gun body and communicates with both the first and second gun mounting bores 42 and 43 via lateral inlet passages 54 and 55. The fluid outlet passage 48 also extends parallel to the horizontal axis of the gun body and likewise communicates with both gun mounting bores via lateral outlet passages 56 and 57.

Air flow passage 50 interconnects the first air pressure line 52 to the gun mounting bore 42 and the air flow passage 51 interconnects the second air flow line 53 to the second gun mounting bore 43.

The gun modules 40, 41 are both pneumatically opened-spring closed check valves which when opened, permit liquid to flow from inlet passage 54, 55 to the guns 38, 37 via an outlet orifice 58. When the valves are closed, liquid flows into the modules through the inlets 54, 55 and out through recirculating outlets 56, 57. The pressurized air which effects opening of the check valves of the modules 40, 41 enters into the pressure chamber of the modules via the axial passage 50, 51 and transverse passages 60.

The two gun modules 40 and 41 each have a threaded nose piece 61 which when the modules are mounted in the gun mounting bores are threaded into threaded section 62 of the nozzle assemblies 37, 38. When the nose pieces are fully threaded into the threaded section 62 flanges 63 of the gun modules contact shoulders 64 formed in bores 42 and 43 to seat and locate the modules in the bores. When so located, the liquid inlet ports 54, 55 of the block 39 are aligned with and in communication with the annular grooves 64 of the modules 40, 41. Furthermore, when the gun modules are so located, the air pressure inlets 60 are aligned with and in communication with the annular grooves 66.

The nozzle assemblies 37 and 38 inlcude static or non-movable mounting blocks or sections 67 and 68 attached to the threaded nose pieces 61 of the gun modules. These mounting sections each have a first generally transverse bore 70 and 71 adapted to receive the adjustable nozzle holders **72*a* and 72*b*, and a second parallel internally threaded bore 69*a*, 69*b* for reception of the nozzle adjustor screws 76**.

Apertures 70, 71 in the mounting sections of the nozzle assemblies 37, 38 lie at a slant relative to the axis of the mounting block 39 and to stubhorn so that the nozzle holders **72*a*, 72*b* mounted within these bores point upwardly and forwardly relative to the axis of this stubhorn 10. Both nozzle holders mounted within the bores 70, 71 are identical and, therefore, only one 72*a*** will be described in detail herein.

The nozzle holder **72*a* includes a shaft 73 and a lip or flange 74 which extends from one side of the shaft. This flange defines a hole 77 through which the adjusting screw 76 extends and is rotatably secured by a conventional snap ring 75**.

The upper outer end of the nozzle holder shaft includes a threaded bore 78 into which is threaded an externally threaded nozzle holder 80. A nozzle 81 is compression fitted into this nozzle holder 80 and a conventional nozzle tip 82 brazed onto the outer end of this nozzle.

The shafts 73 are slidably received within the bores 70 and 71 of the nozzle holders and a seal is maintained between the nozzle holders and the shafts by means of O-rings 83. The adjusting screws 76 are threaded into threaded apertures 69*a*, 69*b* of the mounting blocks. Thus, by turning the adjusting screws 76, the shafts 73 are raised or lowered. Gradations 84 may be provided on the exterior of the nozzle assembly indicating the extend of the adjustment.

When attached to the gun modules 40, 41, the outlet orifice communicates with fluid passages 85, 86 in the nozzle mounting blocks 67, 68. Passages 85 and 86 through the mounting blocks of the nozzle assemblies lead from the outlet orifices 58 of the gun modules 40, 41 to a vertical groove 87 in the wall 88 of the shaft 73. This slot 87, together with the wall 89 or 90 of apertures 70 and 71 define a liquid flow passage 91.

The passage 91 in turns leads to a transverse passage 92 which is directed toward the center axis of the shaft 73. An axial passage 94 of the shaft leads from this transverse passage 92 to the nozzle 81 secured on the upper end of the shaft. This latter axial passage 94 communicates with an axial passage 95 in the nozzle which in turn leads to the orifice 96 of the nozzle tip 82.

The axial passage 94 of the shaft 73 extends for the length of the shaft and is closed at the lower end by a plug 97 threaded into a threaded section at the lower end 98 of the passage 94. This plug 97 may be removed so as to provide an opening for cleaning the nozzle when the gun is not in use.

In operation, the emission of liquid spray from the guns 37 and 38 is turned on and off in synchronization with movement of the can bodies 11 over the stubhorn 10. Further, the apparatus is designed so that the guns alternately spray ever other can.

Activation of a gun is initiated by a can body interrupting a light beam of a photocell sender 99 and receiving/sensor unit 100. Upon each interruption of the light beam, an electrical pulse is sent through a solenoid conduit circuit 101 (see FIG. 1). This solenoid control circuit 101 alternately activates one of two timers 102 and 102*a*. The first timer sends a signal to a first solenoid valve 103 causing a valve spool of the solenoid valve 103 to shift so as to connect the air line 53 to a source of air pressure 104, thereby actuating the first gun module 41 and causing coating material to be emitted from the nozzle orifice 96 of the gun 38.

A predetermined time after the interruption of the light beam, that can which had broken the light beam passes out of alignment with nozzle 81. After that predetermined time, the timer circuit 101 interrupts the signal to solenoid 103, causing it to be de-energized and the control circuit to be reset. Upon de-energization of the solenoid of solenoid valve 103, the spool of valve 103 moves back to the position in which the air line 53 is connected to atmospheric pressure. This results in the valve in gun module 41 closing which immediately cuts off the flow of spray from the nozzle 81 until the timer 102 re-energizes the solenoid of solenoid valve 103.

When the next following can interrupts the light beam, a second electrical pulse is sent through the dual solenoid control circuit 101 which activates the second timer 102*a*. This signal in turn activates the second solenoid 105. In the same manner just described, the second gun module 40 is activated, thereby supplying liquid to the second gun 37 so as to spray liquid onto the second can via the second gun 37.

This alternate firing of the gun is controlled by the dual solenoid control circuit 101. This circuit receives the impulse from the receiving/sensor 100 via an amplifier 106. The signal from the amplifier 106 is detected to: (a) a flip flop circuit 107, (b) a first NAND gate 108, and (c) a second NAND gate 109. The flip flop circuit 107 and each NAND gate 108, 109 receive each impulse.

The flip flop alternately passes the impulse or signal to either the first or second NAND gate 108, 109. Therefore, each NAND gate alternately receives one or two impulses. When a NAND gate receives two impulses, it causes a zero signal to be generated and when only one impulse is received, a positive signal is generated. The output from each NAND gate is received by separate inverters 110 and 111. When a positive signal is received by an inverter, the signal is inverted and a zero signal or no signal is generated. When a zero signal is received, this is inverted, causing a positive signal to be generated. In this manner, while one inverter generates a zero signal, the other inverter generates a positive signal. Thus, each inverter will alternate between a zero and position signal.

The output signal from the first inverter 110 is received by the first timer 102 and the output signal from the second inverter 111 is received by the second timer 102*a*. Thus, consecutive impulses cause a signal to be sent alternately to the two timers. This in turn causes each gun to fire at alternate cans passing over the stubhorn 10.

Using this apparatus in this manner, the line speed of cans produces can be substantially increased. Whereas in the prior art, as exemplified by U.S. Pat. No. 3,921,570, the limiting speed for operating the line was the time interval between consecutive can bodies during which time the gun had to be turned off and on. According to the practice of this invention, the limiting factor is the length of the can. As long as a gun can turn off within the time required for a can to pass, the present apparatus will function to spray all cans via alternate guns spraying consecutive cans in the line.

While only one preferred embodiment of this invention has been described in detail herein, those persons skilled in the art to which this invention pertains will readily appreciate numerous changes and alterations which may be made without departing from the spirit of this invention. Therefore, I do not intend to be limited except by the scope of the appended claims.

Having thus described my invention, I claim:

1. A method of applying coating material onto the inside of consecutive can bodies moving along a can forming line comprising:

applying coating material from a first spray coating means onto the inside of alternate can bodies moving past said first spray coating means along the can forming apparatus; and applying coating material from a second spray coating means onto the inside of alternate can bodies following those to which coating material was applied by said first spray coating means.

2. A method of applying coating material onto the inside of consecutive can bodies moving along a can forming line comprising:

applying coating material from a first coating means onto the inside of only selected ones of the consecutive can bodies moving past said first coating means along the can forming apparatus; and applying coating material from a second coating means onto the inside of only selected other ones of the consecutive can bodies to which coating material was applied by said first coating means.

3. A method of applying coating material onto the inside of consecutive can bodies moving along a can forming line comprising:

spraying coating material from a first spray coating means onto the inside of only selected ones of the consecutive can bodies moving past said first spray coating means along the can forming apparatus; and spraying coating material from a second spray coating means onto the inside of only selected other ones of the consecutive can bodies to which coating material was applied by said first spray coating means.

* * * * *

UNITED STATES PATENT AND TRADEMARK OFFICE

CERTIFICATE OF CORRECTION

PATENT NO. : 4,414,248

DATED : Nov. 8, 1983

INVENTOR(S) : James A. Kolibas

It is certified that error appears in the above-identified patent and that said Letters Patent is hereby corrected as shown below:

Column 1, line 48, after "apparatus" insert -- attached--

Column 2, line 57, "read" should be -- rear --

Column 3, line 62, after 43 "or" should be -- of --

Column 4, line 27, "passage" should be -- passages --

Column 6, line 4, "detected" should be -- directed --

Signed and Sealed this

*Sixth* Day of *November 1984*

[SEAL]

*Attest:*

GERALD J. MOSSINGHOFF

*Attesting Officer*

*Commissioner of Patents and Trademarks*